US012454814B2

(12) United States Patent
Kowol

(10) Patent No.: US 12,454,814 B2
(45) Date of Patent: Oct. 28, 2025

(54) SANITATION FUNCTIONAL UNIT AND CORRESPONDING DESIGN SERIES AND MODULAR CONSTRUCTION KIT

(71) Applicant: Neoperl GmbH, Müllheim (DE)

(72) Inventor: Jacek Kowol, Gundelfingen (DE)

(73) Assignee: NEOPERL GMBH, Muellheim (DE)

( * ) Notice: Subject to any disclaimer, the term of this patent is extended or adjusted under 35 U.S.C. 154(b) by 155 days.

(21) Appl. No.: 18/277,600

(22) PCT Filed: Mar. 11, 2022

(86) PCT No.: PCT/EP2022/056372
§ 371 (c)(1),
(2) Date: Aug. 17, 2023

(87) PCT Pub. No.: WO2022/194708
PCT Pub. Date: Sep. 22, 2022

(65) Prior Publication Data

US 2024/0133165 A1 Apr. 25, 2024
US 2024/0229431 A9 Jul. 11, 2024

(30) Foreign Application Priority Data

Mar. 19, 2021 (DE) ..... 202021101411.3

(51) Int. Cl.
*E03C 1/04* (2006.01)

(52) U.S. Cl.
CPC .... *E03C 1/0401* (2013.01); *E03C 2001/0415* (2013.01)

(58) Field of Classification Search
CPC ..... E03C 1/0401; E03C 2001/0415; E03C 1/042; Y10T 137/6977
USPC ..... 137/801
See application file for complete search history.

(56) References Cited

U.S. PATENT DOCUMENTS

| | | | | |
|---|---|---|---|---|
| 8,342,431 | B2 | 1/2013 | Stein et al. | |
| 8,863,769 | B2 | 10/2014 | Andersen et al. | |
| 10,260,216 | B2 * | 4/2019 | Zhu | E03C 1/0404 |

FOREIGN PATENT DOCUMENTS

| | | |
|---|---|---|
| CN | 107326970 | 11/2017 |
| DE | 10016976 | 10/2001 |
| DE | 20303522 | 6/2003 |
| DE | 10243305 | 3/2004 |
| DE | 102015219175 | 4/2017 |
| GB | 1515257 | 6/1978 |

* cited by examiner

*Primary Examiner* — Daphne M Barry
(74) *Attorney, Agent, or Firm* — Volpe Koenig

(57) ABSTRACT

In a sanitary functional unit (1) having a housing (5) and a holding element (2) which at least in portions encompasses the housing, the holding element contacts the housing in a gripping portion (6) and this gripping portion (6) is manufactured to be oversized in relation to the housing.

21 Claims, 14 Drawing Sheets

SANITATION FUNCTIONAL UNIT AND CORRESPONDING DESIGN SERIES AND MODULAR CONSTRUCTION KIT

CROSS-REFERENCE TO RELATED APPLICATIONS

This application is a 371 National Phase of PCT.EP2022/056372, filed Mar. 11, 2022, which claims priority to German Patent Application No. 20 2021 101 411.3, filed Mar. 19, 2021, both of which are incorporated herein by reference as if fully set forth.

TECHNICAL FIELD

The invention relates to a sanitary functional unit having a housing and a holding element which at least in regions encompasses the housing.

Sanitary functional units are known in the prior art and are referred to as a mixer cartridge or valve, for example servo valve, or else as a water outlet.

The invention furthermore relates to a design series of sanitary functional units. Such a design series is known.

The invention furthermore relates to a construction kit for a sanitary functional unit and/or for forming a design series. Such a construction kit is known.

BACKGROUND

It has become commonplace in the sanitary industry to reflect on how functional units of this type can be designed to be water-conducting without having to resort to the holding function of a fitting, in particular of a sanitary fitting.

The holding function in sanitary functional units is usually established with the aid of nuts which act as holding elements. However, this can significantly prolong the assembly time for such functional units and often leads to assemblies which are not fastened with an exact fit and/or become loose over time, such that the functional unit is imparted an unintentional freedom of movement that can compromise the operating comfort of a user.

SUMMARY

The invention is based on the object of improving the holding function of a sanitary functional unit, of preventing the use of nuts as holding elements, and of enabling rapid, reliable assembling to an exact fit without having to resort to the holding function of a fitting. The object is achieved by the features of the independent claims. Advantageous design embodiments are described in the dependent claims.

For achieving this object, the invention provides for the use of one or more of the features disclosed herein. In a sanitary functional unit of the type described at the outset the invention thus proposes in particular for achieving the mentioned object that the holding element contacts the housing in a gripping portion and in this gripping portion is manufactured so as to be oversized in relation to the housing. In this way, it can be achieved that the housing is freely held on a fastening element or external body, for example an item of furniture.

In this context, oversized means that the measurement of one or a plurality of parts of the holding element is greater than that of the gripping portion which is disposed on the housing of the sanitary functional installation.

The use of an oversize for fixing is advantageous because the use of screws or nuts can be dispensed with in this way, and the overall time for assembling can thus also be minimized.

A gripping portion is understood to be the contact area between the holding element and the housing.

It is preferable for the gripping portion to extend across at least 180° and/or at least half the circumference of the housing. In this way, holding elements of different shapes can be kept available for contacting the gripping portion.

At least one encircling collar which provides the gripping portion is preferably configured on the housing. In this way, the gripping portion can be provided in a simple manner in terms of construction.

In a further advantageous design embodiment it can be provided that an anti-rotation safeguard is configured in the gripping portion and the holding element. It is advantageous for the anti-rotation safeguard to have some play. The anti-rotation safeguard can be configured in the form of a tongue-and-groove assembly, for example. In this way, the anti-rotation safeguard can be provided in a simple manner in terms of construction.

In a further advantageous design embodiment it can be provided that the holding element is configured to be annular. In this way, the holding element can grip the housing along the entire circumference, and any movement in all the radial directions relative to the housing can be prevented.

In a further advantageous design embodiment it can be provided that the holding element is yoke-shaped. In this way, a movement in a specific radial direction relative to the housing can be prevented.

In a further advantageous design embodiment it can be provided that the holding element has at least one fastening means for fastening to a support structure. It is advantageous for the fastening means to be a latching arrangement and additionally or alternatively a fastening bore. It is advantageous for the support structure to be an item of furniture. In this way, fastening of the holding element to a support structure can be achieved by a measure which is simple in terms of construction.

In a further advantageous design embodiment it can be provided that the sanitary functional unit has at least one externally accessible activating element. It is advantageous for the activating element to be coupled to a push-push mechanism. In this way, the volumetric flow of one or a plurality of liquids through the sanitary functional unit can be regulated.

A user can adjust or stop the volumetric flow of liquids by rotating, pressing or tilting the activating element, and likewise adjust the temperature of the outflowing liquid.

In a further advantageous design embodiment it can be provided that the sanitary functional unit has at least one valve. It can be achieved in this way that the flow of liquids is blocked or controlled.

In a further advantageous design embodiment it can be provided that the housing has at least one connector for a water conduit. It is advantageous for the gripping portion to be disposed between the at least one connector and the, or an, activating element. In this way, the sanitary functional unit can be attached to pipelines. The sanitary functional unit can likewise be attached to hose lines.

In a further advantageous design embodiment it can be provided that the holding element on the inside thereof has at least one protrusion which is insertable into a housing recess, so that an anti-rotation safeguard is achieved. It is advantageous for the anti-rotation safeguard to have some play. In this way, the anti-rotation safeguard can be achieved by a simple measure in terms of construction.

In a further advantageous design embodiment it can be provided that an oblique internal face is fashioned on the holding element. In this way it can be achieved that the holding element and the housing can be plugged into one another to an exact fit.

In a further advantageous design embodiment it can be provided that the at least one encircling collar is beveled. In this way it can be achieved that the housing and the holding element can be plugged into one another to an exact fit.

In a further advantageous design embodiment it can be provided that the holding element has at least one flexible tongue which engages with at least part of the gripping portion. It is advantageous for a play-free mounting between the holding element and the housing to be achieved. It is advantageous for the flexible tongue to be able to be folded inward. In this way, it can be achieved that the holding element is permanently fixed to the housing. The play-free mounting can be achieved in that the flexible tongue is oversized in relation to the gripping portion.

In a further advantageous design embodiment it can be provided that the holding element has at least one spring web which is coupled to the flexible tongue. It is advantageous for the spring web to be deformable. In this way, simultaneous fixing between the housing and the holding element on the one hand, and the holding element and the external body on the other hand, can be achieved.

In a further advantageous design embodiment it can be provided that the preferably yoke-shaped holding element has a thickness which increases from the inside to the outside, so that a play-free mounting between the holding element and the housing is achieved. The oversize can thus be produced in a simple manner. The cross section of the holding element can be trapezoidal or triangular.

In a further advantageous design embodiment it can be provided that the holding element on the external side has at least one axial groove which is connectable to an external body, so that an anti-rotation safeguard, which has some play, between the external body and the holding element is achieved. In this way, a relative rotating movement between the external body and the holding element can be prevented.

In a further advantageous design embodiment it can be provided that an external spring is disposed on the external side of the holding element, wherein the external spring at the end side can be introduced into the external body, so that a play-free extraction safeguard is achieved. It is advantageous for the external spring to be able to snap onto a resting shoulder of the external body. In this way it can be provided that the holding element is durably fixed to the external body in a manner which is rapid and simple in terms of construction.

In a further advantageous design embodiment it can be provided that the holding element is manufactured from plastics material. In this way, a cost-effective holding element which is easy to transport can be provided.

The invention furthermore relates to a design series of sanitary functional units having at least two variants, wherein each variant is configured as a sanitary functional unit according to one of the design embodiments mentioned above, wherein the variants have identical housings and mutually deviating holding elements. In this way, different plug-in directions or types of fastenings can be implemented.

In a further advantageous design embodiment of the design series it can be provided that in a first variant the holding element encompasses the housing in an annular manner, and in a second variant the holding element encompasses the housing only partially.

In a further advantageous design embodiment of the design series it can be provided that in a first variant the holding element has at least one fastening means which defines a first plug-in direction, and in that in a second variant the holding element has at least one fastening means which defines a second plug-in direction which is counter to the first plug-in direction. In this way, different plug-in directions can be implemented, and access to locations that are difficult to reach for the user can be facilitated.

The invention furthermore relates to a construction kit for a sanitary functional installation according to one of the features mentioned above, and additionally or alternatively for forming a design series according to the design embodiments mentioned above, wherein the construction kit has at least one housing and at least two different holding elements which match the housing.

BRIEF DESCRIPTION OF THE DRAWINGS

The invention will now be described in more detail with reference to a few exemplary embodiments, but is not limited to these few exemplary embodiments. Further variants of the invention and exemplary embodiments are derived by combining the features of individual or several claims with one another and/or with individual or several features of the exemplary embodiments and/or of the previously described variants of devices according to the invention.

In the Figures.

DETAILED DESCRIPTION

In the description hereunder of different exemplary embodiments of the invention, functionally equivalent elements are provided with the same reference signs even in the event of a variance in terms of design or shape.

Figure 1:
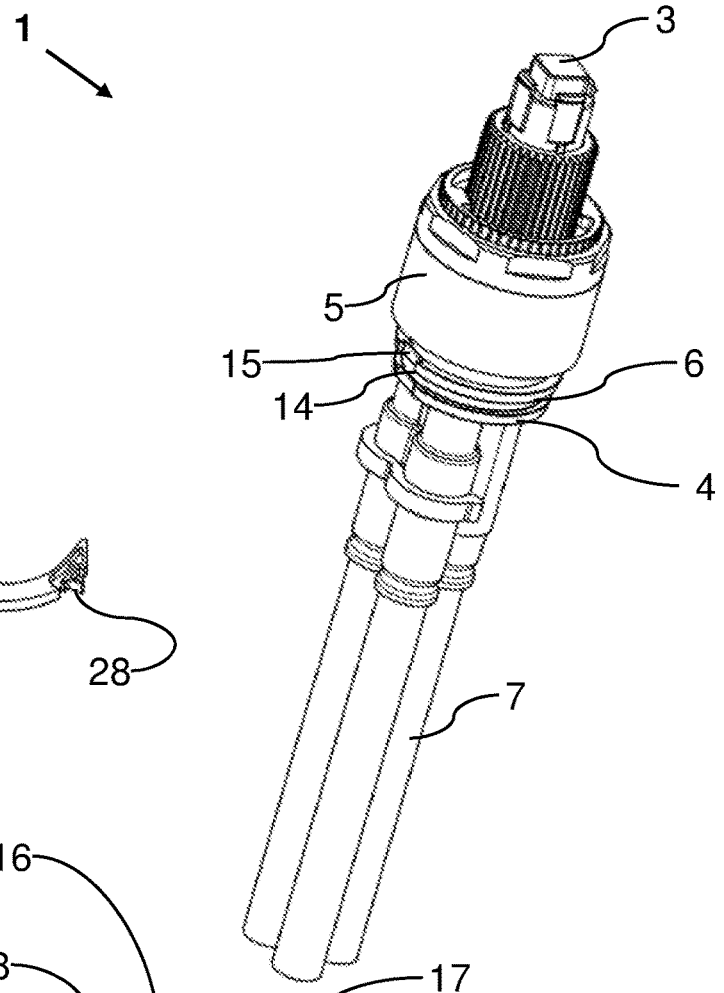
FIG. 1 shows a housing of a sanitary functional unit.

FIG. 1 shows the housing 5 of a sanitary functional unit 1 in a perspective view. The sanitary functional unit 1 possesses an activating element 3 which is able to be operated by a user and which by rotating or pressing can regulate or block a volumetric flow of liquid. The sanitary functional unit 1 possesses pipelines 7, in the specific case three pipelines 7, wherein two are utilized for the inflow and one is utilized for the outflow. An encircling collar 4 which defines a gripping portion 6 is configured on the housing 5. A housing recess 15 is likewise defined on the housing 5.

Figure 2:
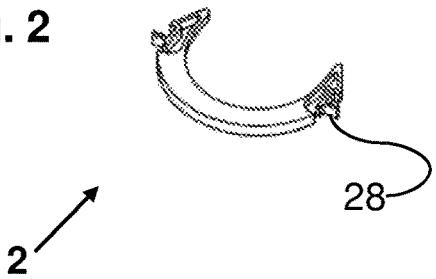
FIG. 2 shows a holding element, fashioned as a holding yoke.

FIG. 2 shows a holding element 2 which is fashioned as a holding yoke, in a perspective view. The holding element 2 possesses two yoke springs 28. The holding element 2 can grip the housing 5 at least across half the circumference. The yoke springs 28 are provided for fastening to an external body 18 or a fitting part 26. The thickness of the holding element 2 increases from the inside to the outside, wherein the cross section of the holding element 2 is trapezoidal. The cross section of the holding element 2 may have other shapes, for example be triangular.

Figure 3:
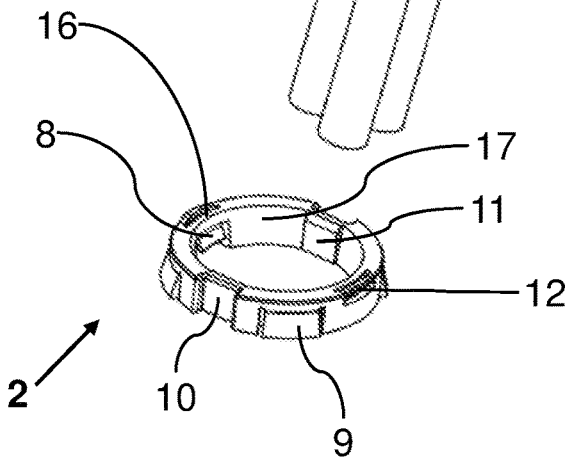
FIG. 3 shows another holding element, fashioned as an annular holder.

FIG. 3 shows another holding element 2 which is fashioned as an annular holder, in a perspective view. The holding element 2 on the inside possesses two protrusions 11 which are disposed so as to be directly mutually opposite, i.e. at an angle of 180°. Two axial grooves 10 are disposed on the external side of the holding element 2, so as to bear on the protrusions 11. The axial grooves 10 have a rectangular or square shape, wherein a trapezoidal shape is also conceivable. External springs 9 which protrude outward are disposed on the external side of the holding element 2. The holding element 2 furthermore possesses two flexible tongues 8 which protrude into the interior part of the holding element 2. Two spring webs 12 which each possess one web bore 16 are on the external edge of the holding element. The flexible tongues 8 are coupled to the spring webs 12 and are mutually contiguous. The holding element 2 possesses an oblique internal face 17.

Figure 4:
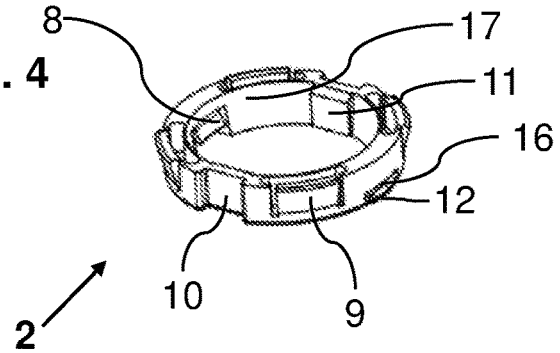
FIG. 4 shows another holding element, fashioned as an annular holder.

FIG. 4 shows another holding element 2 which is fashioned as an annular holder, in a perspective view. The holding element 2 from FIG. 4 possesses the same features as the holding element 2 from FIG. 3. The internal sides are identical, and the positioning of protrusions 11 and flexible tongues 8 is identical. The elements on the external side of the holding element 2 in FIG. 4 are mirror-inverted in relation to the elements on the external side of the holding element 2 in FIG. 3. This relates to the external springs and to the spring webs.

Figure 5:
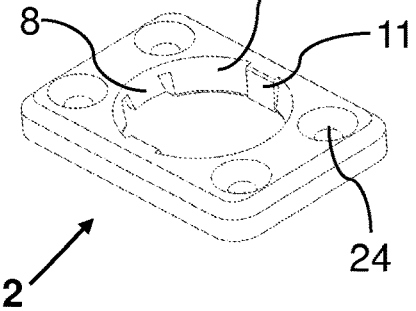
FIG. 5 shows another holding element, fashioned as a holding disk.

FIG. 5 shows another holding element 2 which is fashioned as a holding disk, in a perspective view. The holding element 2 on the internal side possesses two protrusions 11 which are disposed at 180° relative to one another. Flexible tongues 8 which protrude into the internal side of the holding element 2 are fashioned so as to be orthogonal to the protrusions. The holding element 2 possesses fastening bores 24 through which screws 23 are able to be guided in order to be able to fasten the holding element 2 to a receptacle body 25. The holding element has an oblique internal face.

Figure 6:
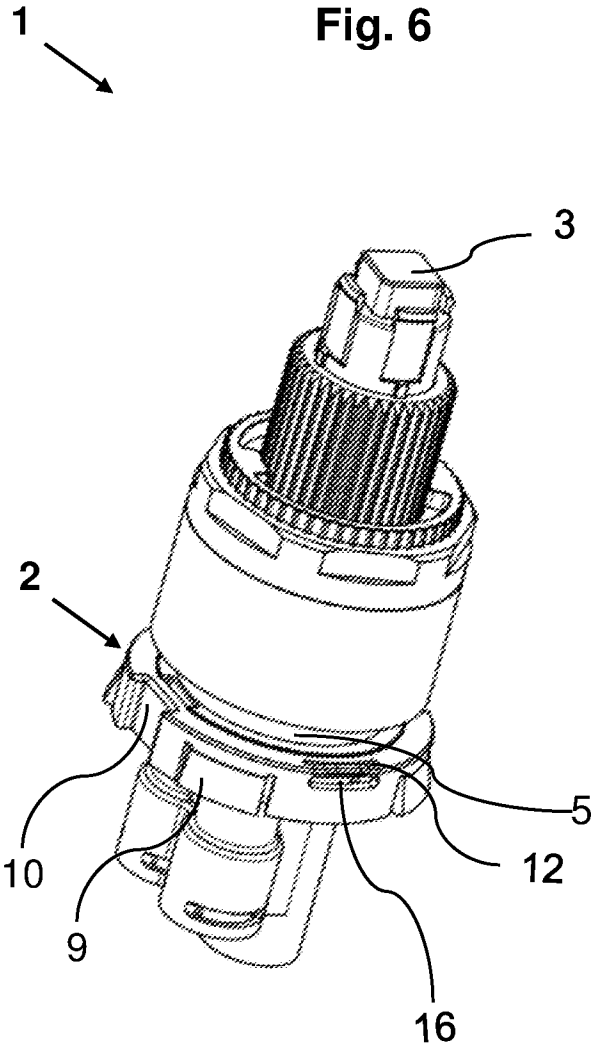
FIG. 6 shows a sanitary functional unit in a perspective view.

FIG. 6 shows a sanitary functional unit 1 in a perspective view, wherein the housing 5 and the holding element 2 are plugged into one another. The holding element 2 is preferably manufactured from plastics material.

Figure 7:
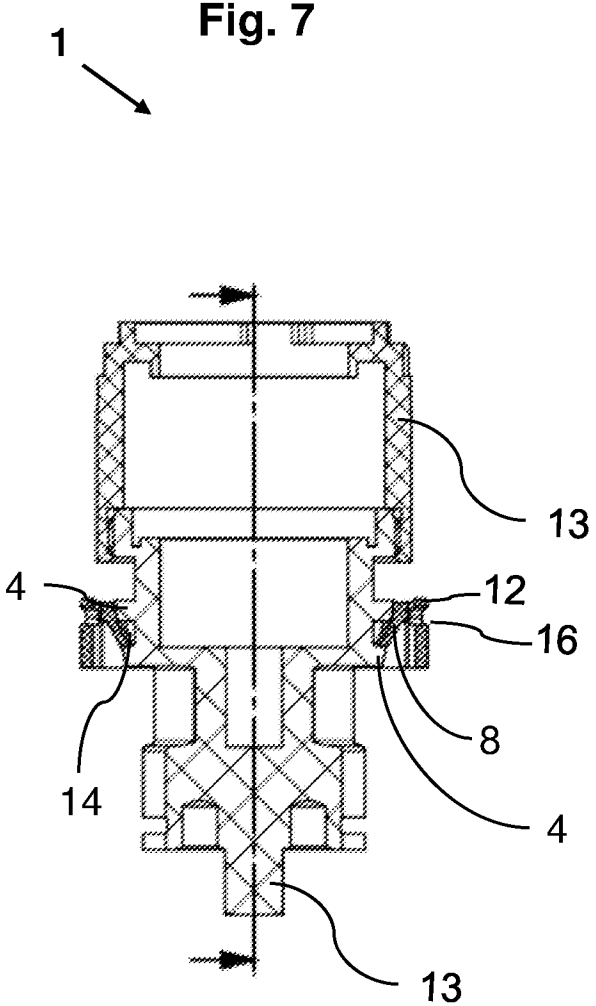
FIG. 7 shows a section through the sanitary functional unit from FIG. 6.

FIG. 7 shows a section through the sanitary functional unit 1 from FIG. 6, wherein the section runs through the flexible tongue 8 and the spring web 12 of the holding element 2. The housing 5 is composed of housing parts 13 which are connected to one another, for example by way of a threaded connection. The housing 5 possesses two encircling collars 4 which are beveled and mutually spaced apart. A collar trench 14 is configured between the encircling collars 4. The encircling collar 4 provides the gripping portion 6. The housing 5 is introduced into the holding element 2 from above, whereby the flexible tongues 8 snap into the collar trench 14. The flexible tongue 8 is supported by an encircling collar 4 at the head end, while the flexible tongue 8 at the foot end bears on the other encircling collar 4. The flexible tongues 8 are manufactured so as to be oversized in relation to the housing 5. Introducing the housing 5 into the holding element 2, and the snap fitting, require a certain use of force, whereby the flexible tongues 8 and the spring web 12 are deformed so as to overcome the geometric obstacle of the oversize. This creates a play-free extraction safeguard which prevents an axial displacement of the housing 5 in relation to the holding element 2. The spring web 12 is deformable in the direction of the web bore 16 bearing thereon. The head side of the flexible tongue 8 is positioned on the spring web 12.

Figure 8:
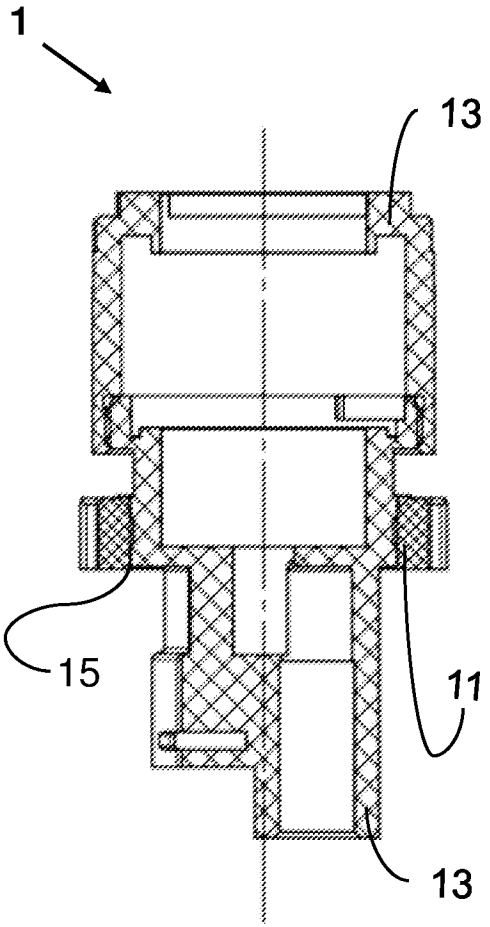
FIG. 8 shows another section through the sanitary functional unit from FIG. 6.

FIG. 8 shows another section through the sanitary functional unit 1 from FIG. 6, wherein the section runs through the axial groove 10 and the protrusion 11. The main axis of the sanitary functional unit 1 is illustrated as a chain-dotted line. The protrusion 11 of the holding element 2 fits exactly into a reciprocating housing recess 15 which is fashioned on the housing 5. The encircling collar 4 cannot be seen here because it is interrupted by the housing recess 15. This here creates a safeguard with slight play which prevents a rotation between the holding element 2 and the housing 5.

Figure 9:
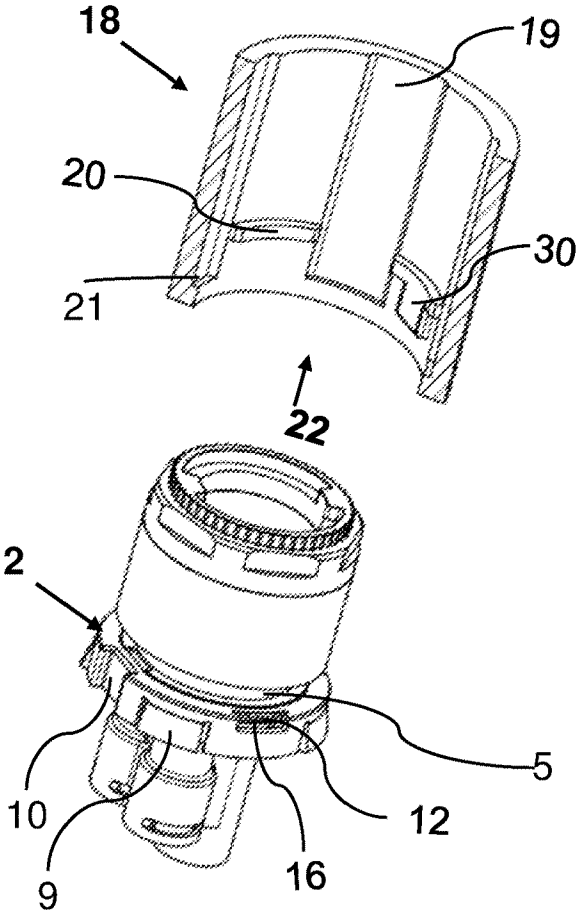
FIG. 9 shows a sanitary functional unit in a perspective view, and a section through an external body.

FIG. 9 shows a sanitary functional unit 1 in a perspective view, and a section through the external body 18. The holding element 2 and the housing 5 have already been connected to one another. The plug-in direction 22 is symbolized by the arrow. The external body 18 on the internal side possesses an external body shoulder 20, an elongate external body groove 19, and an external body protrusion 30. A resting shoulder 21 is fashioned on one end of the external body groove 19. The number of axial grooves 10 on the holding element 2 corresponds to the number of external body protrusions 30. The number of external body grooves 19 corresponds to the number of external springs 9 on the holding element 2. When plugging-in the external body 18, the external body protrusion 30 fits into the axial groove 10, whereby an anti-rotation safeguard is achieved. The spring web 12 contacts the external body shoulder 20 and is deformed by the latter. The flexible tongue 8 is pressed more intensely in the direction of the housing 5 in the process. The external spring 9 proximal to the foot snaps onto the resting shoulder 21. The bearing action of the external body shoulder 20 on the spring web 12, in conjunction with the bearing action of the external spring 9 on the resting shoulder 21, ensures an extraction safeguard. A permanent connection between the housing 5 and the external body 18 is achieved with the aid of the holding element 2. A sanitary fitting is not required here so that a fastening to a support structure, for example an item of furniture, can be achieved.

Figure 10:
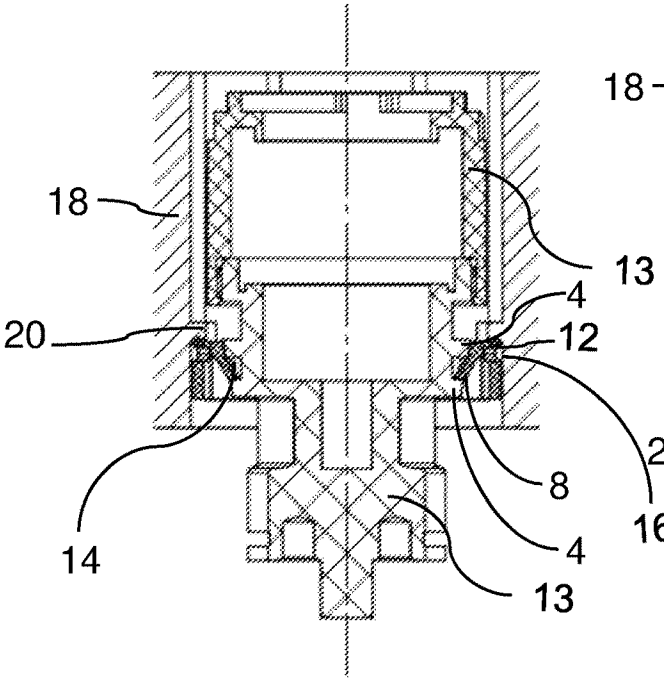
FIG. 10 shows a section through the sanitary functional unit plugged together with the external body.

FIG. 10 shows a section through the sanitary functional unit 1 which is plugged together with the external body 18, wherein the section runs through the flexible tongue 8 and the spring web 12. As a result of contacting the external body shoulder 20, the spring web 12 is deformed and presses the flexible tongue 8 into the gripping portion 6 of the housing 5 in the process. The flexible tongue 8 is dimensioned so as to be oversized in relation to the gripping portion 6, so that a play-free extraction safeguard is achieved.

Figure 11:
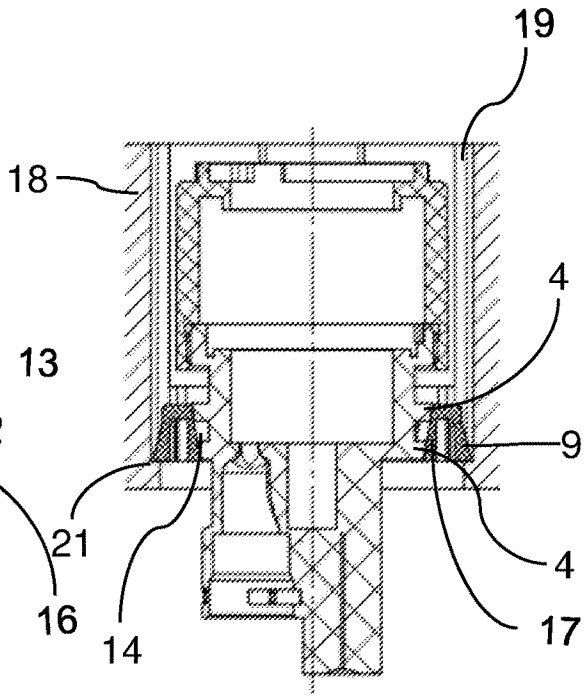
FIG. 11 shows another section through the sanitary functional unit plugged together with the external body.

FIG. 11 shows another section through the sanitary functional unit 1 which is plugged together with the external body 18, wherein the section has been performed through the external spring 9. This shows how the external spring 9 of the holding element 2 bears on the resting shoulder 21 of the external body 18. The spring web 12 (not illustrated) ensures that the external spring 9 is pressed onto the resting shoulder 21 of the external body 18. The encircling collars 4 are beveled and lie directly on the oblique internal face 17 of the holding element 2. The bevel ensures inter alia that the housing cannot slide downward, whereby the play-free extraction safeguard is guaranteed by the flexible tongue 8 (FIG. 10).

Figure 12:
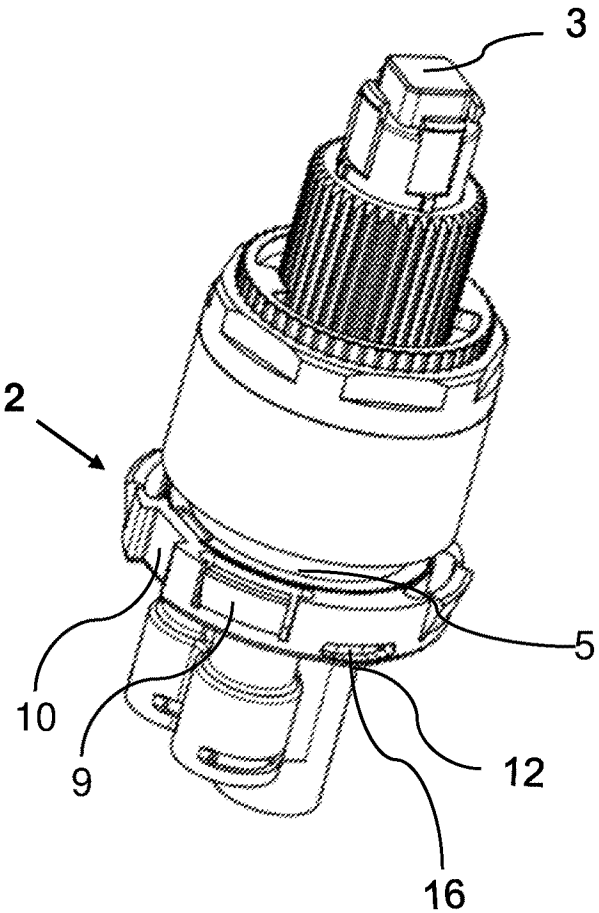
FIG. 12 shows another sanitary functional unit in a perspective view.

FIG. 12 shows another sanitary functional unit 1 in a perspective view. The assembly is similar to that of FIG. 6; however, the holding element 2 is used here, which is mirror-inverted on the external side. The spring web 12 is disposed on the side of the pipelines 7. The head side of the external springs 9 is likewise disposed on the side of the pipelines 7. The holding element 2 is situated between the pipelines 7 and the activating element 3. The gripping portion 6 is disposed between the activating element 3 and the connector for a water conduit.

Figure 13:
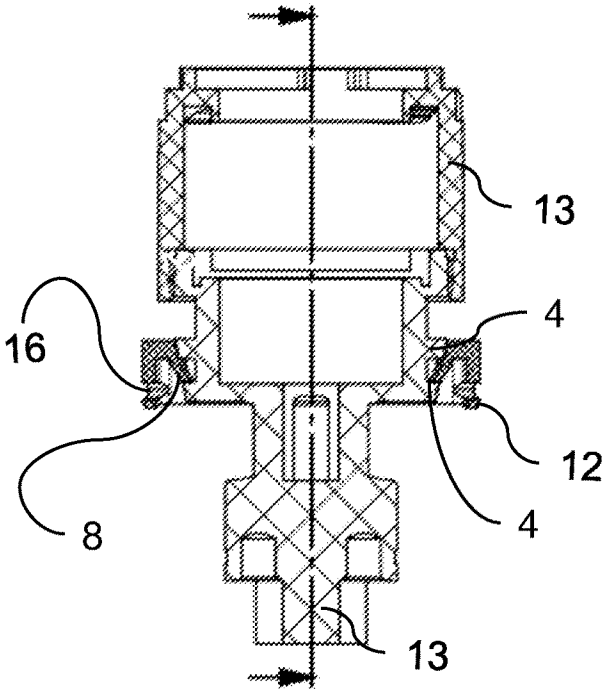
FIG. 13 shows a section through the sanitary functional unit from FIG. 12.

FIG. 13 shows a section through the sanitary functional unit 1 from FIG. 12, wherein the section has been performed through the flexible tongue 8 and the spring web 12. The foot side of the flexible tongue 8 is disposed on the spring web 12, and is thus mirror-inverted in relation to the exemplary embodiment in FIG. 7. The explanations pertaining to FIG. 7 apply here in an analogous manner.

Figure 14:
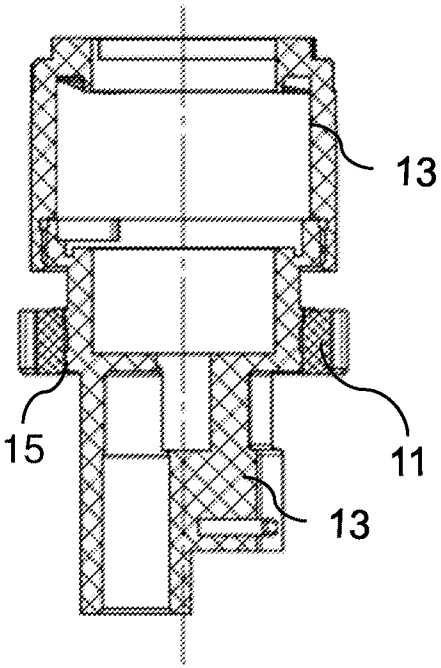
FIG. 14 shows another section through the sanitary functional unit from FIG. 12.

FIG. 14 shows another section through the sanitary functional unit 1 from FIG. 12, wherein the section has been performed through the protrusion 11 of the holding element 2. The explanations and reference signs apply in an analogous manner as in FIG. 8.

Figure 15:
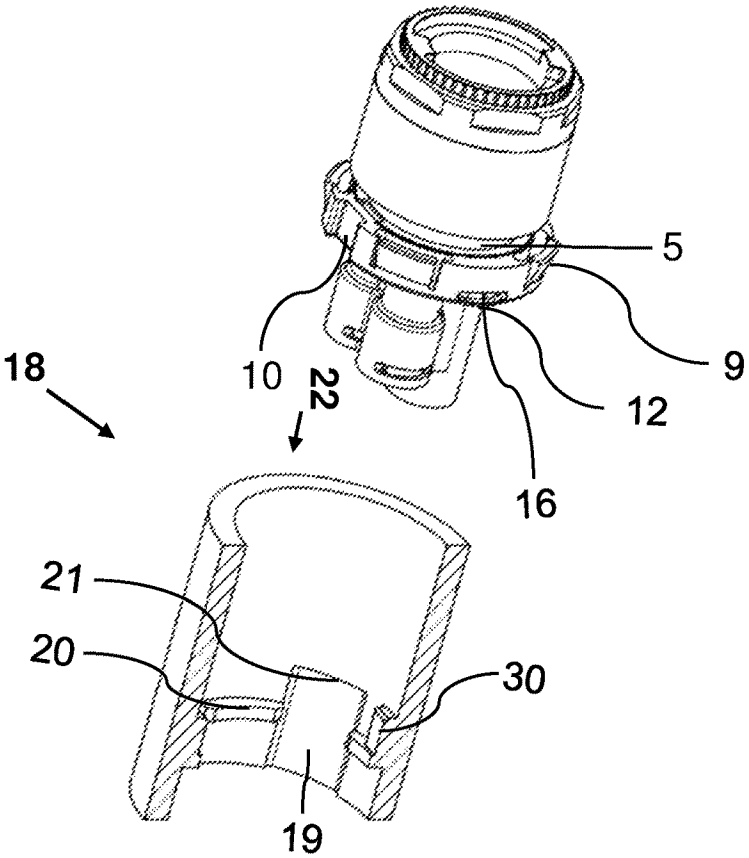
FIG. 15 shows a sanitary functional unit in a perspective view, and a section through an external body.

FIG. 15 shows a sanitary functional unit 1 in a perspective view, and a section through the external body 18. The plug-in direction 22 is illustrated by the arrow. The head side of the external spring 9 and the spring web 12 of the holding element 2 are positioned in the plug-in direction 22. The external body 18 possesses an external body groove 19, an external body shoulder 20, an external body protrusion 30 and a resting shoulder 21. The number of external body grooves 19 corresponds to the number of external springs 9. The number of external body protrusions 30 corresponds to the number of axial grooves 10.

Figure 16:
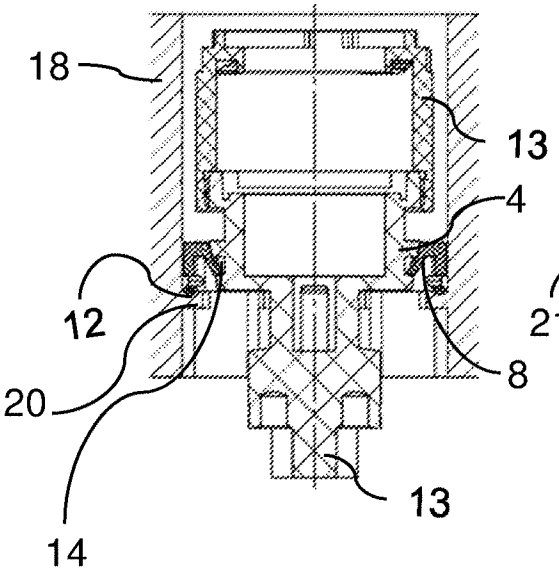
FIG. 16 shows a section through the sanitary functional unit plugged together with the external body.

FIG. 16 shows a section through the assembled module from FIG. 15, wherein the section has been performed through the flexible tongues 8 and the spring web 12. The spring web 12 is pressed against the external body shoulder 20 and simultaneously presses the flexible tongue 8 into the gripping portion 6. The flexible tongue 8 is manufactured so as to be oversized in relation to the housing 5. A certain plug-in force is required in order for the holding element 2 and the housing 5 to be connected. The flexible tongue 8 is coupled to the spring web 12. Two encircling collars 4 which are beveled can be seen. The flexible tongue 8 proximal to the head contacts the one encircling collar 4 and proximal to the foot bears on the other encircling collar 4.

Figure 17:
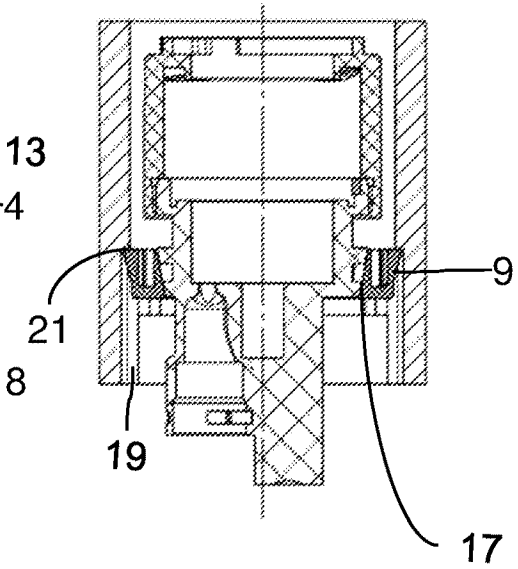
FIG. 17 shows another section through the sanitary functional unit plugged together with the external body.

FIG. 17 shows another section through the sanitary functional unit 1 which is plugged together with the external body 18, wherein the section has been performed through the external spring 9. The oblique internal face 17 of the holding element 2 is disposed so as to be an exact fit with the beveled encircling collars 4. The snap-fit of the external springs 9 on the resting shoulder 21 leads to the sanitary functional unit being permanently fastened to the external body.

Figure 19:
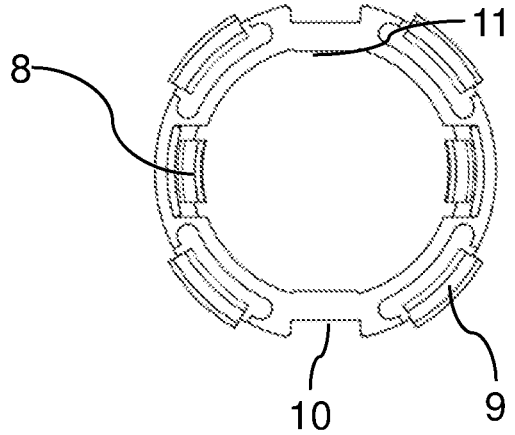
FIG. 19 shows a view from below of the holding element of FIG. 18.
Figure 18:
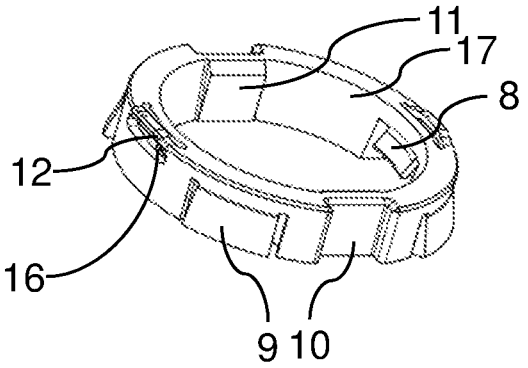
FIG. 18 shows a holding element, fashioned as an annular holder, in a perspective view from transversely above.
Figure 20:
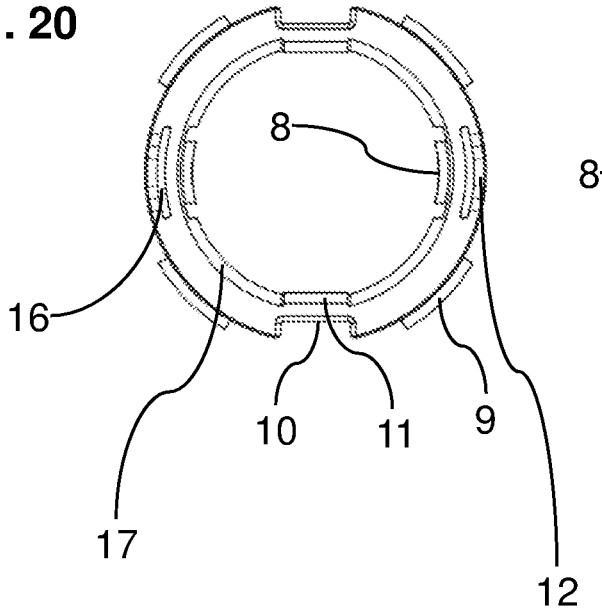
FIG. 20 shows a view from above of the holding element of FIG. 18.
Figure 21:
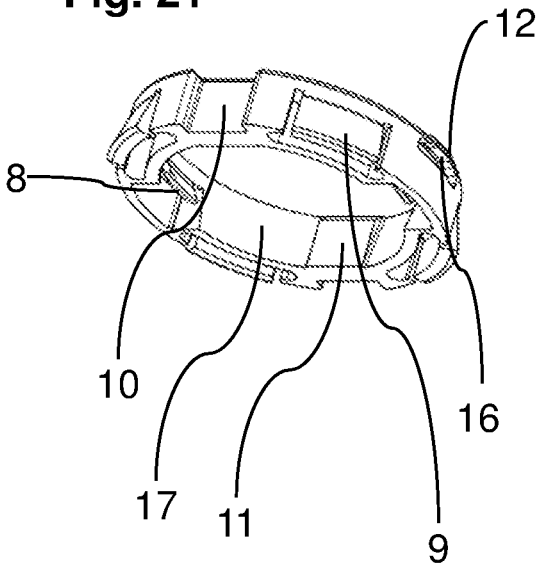
FIG. 21 shows a perspective view from transversely below of the holding element from FIG. 18.

FIG. 18 shows a holding element 2 which is fashioned as an annular holder, in a perspective view from transversely above. This here is the same holding element from FIG. 3, or which is illustrated in FIGS. 6 to 8. FIG. 19 shows a view from below of the holding element 2 of FIG. 18. FIG. 20 shows a view from above of the holding element 2 from FIG. 18. FIG. 21 is a perspective view from transversely below of the holding element 2 from FIG. 18.

Figure 23:
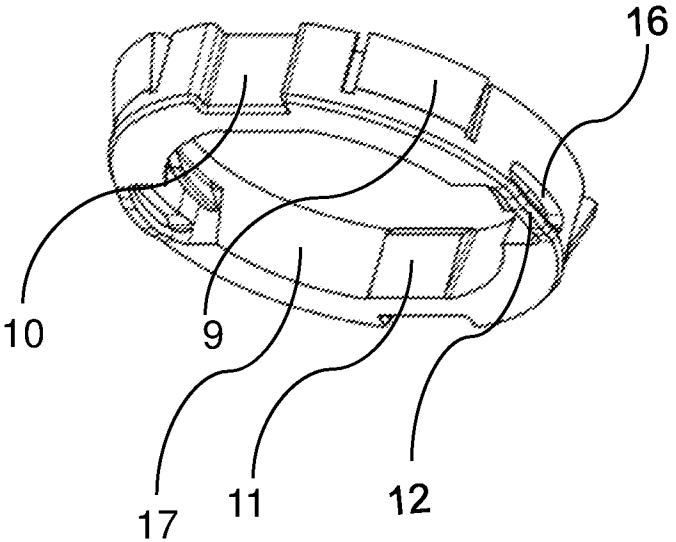
FIG. 23 shows the holding element from FIG. 22 in a perspective view from transversely below.
Figure 22:
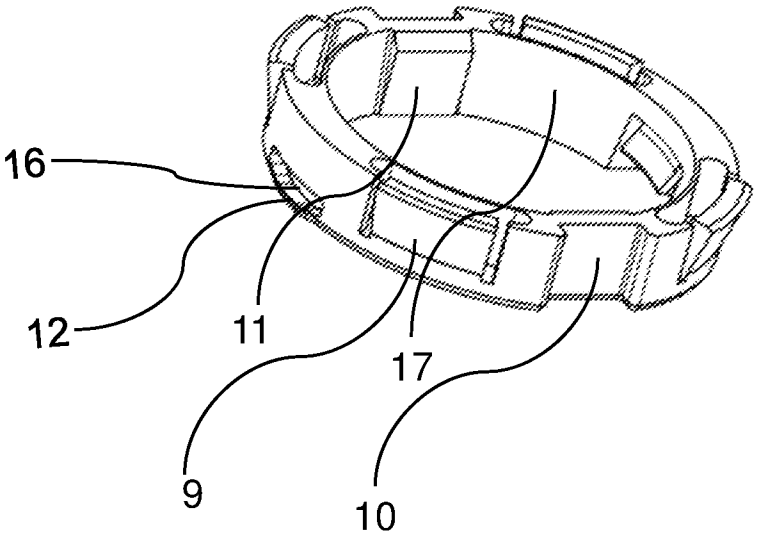
FIG. 22 shows another holding element in a perspective view from transversely above.

FIG. 22 shows another holding element 2 in a perspective view from transversely above. FIG. 23 shows the holding element 2 in a perspective view from transversely below. The holding element 2 is identical to the holding element 2 from FIG. 4, or from FIGS. 15 to 17.

Figure 24:
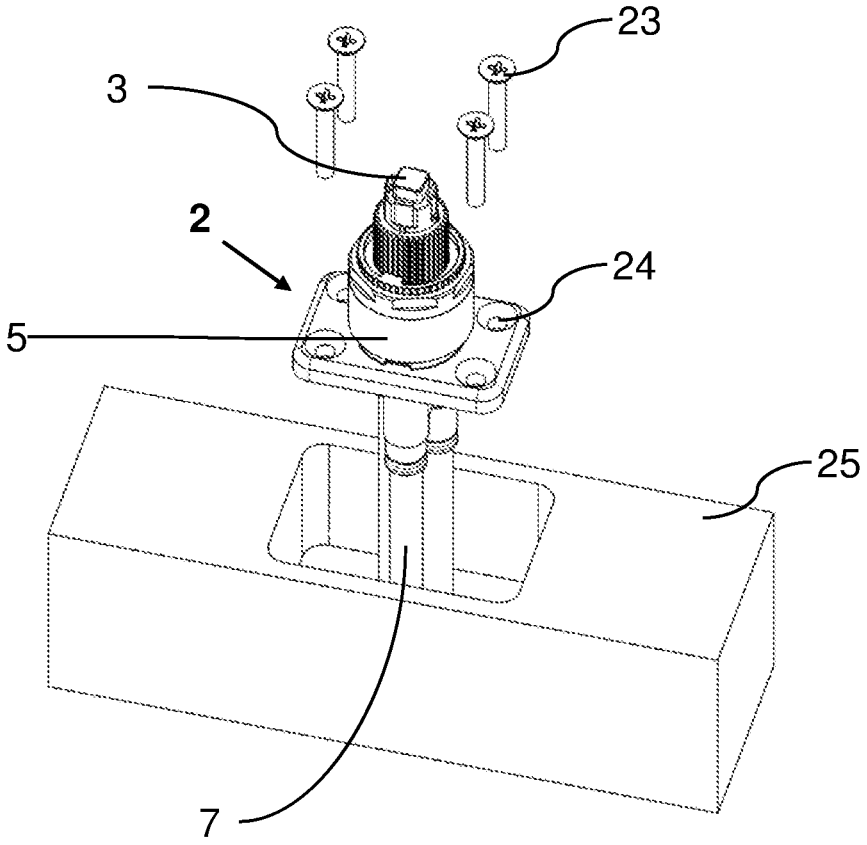
FIG. 24 shows an exploded illustration of an assembly module of a sanitary functional unit having a holding element which is fashioned as a holding disk.

FIG. 24 shows an exploded illustration of an assembly module of a sanitary functional unit 1 having a holding element 2 which is fashioned as a holding disk. The holding element 2 has four fastening bores 24 through which screws 23 are able to be guided. The holding element 2 is connected to the housing 5. The sanitary functional unit 1 is connected to pipelines 7 which enable a connection to a water conduit. The holding element 2 can be connected to a receptacle body 25 using the screws 23. The assembling of such a structure in which a holding disk is used is somewhat more time-intensive than the assembling of a structure in which holding elements 2 which are fashioned as annular holders or holding yokes are used.

Figure 25:
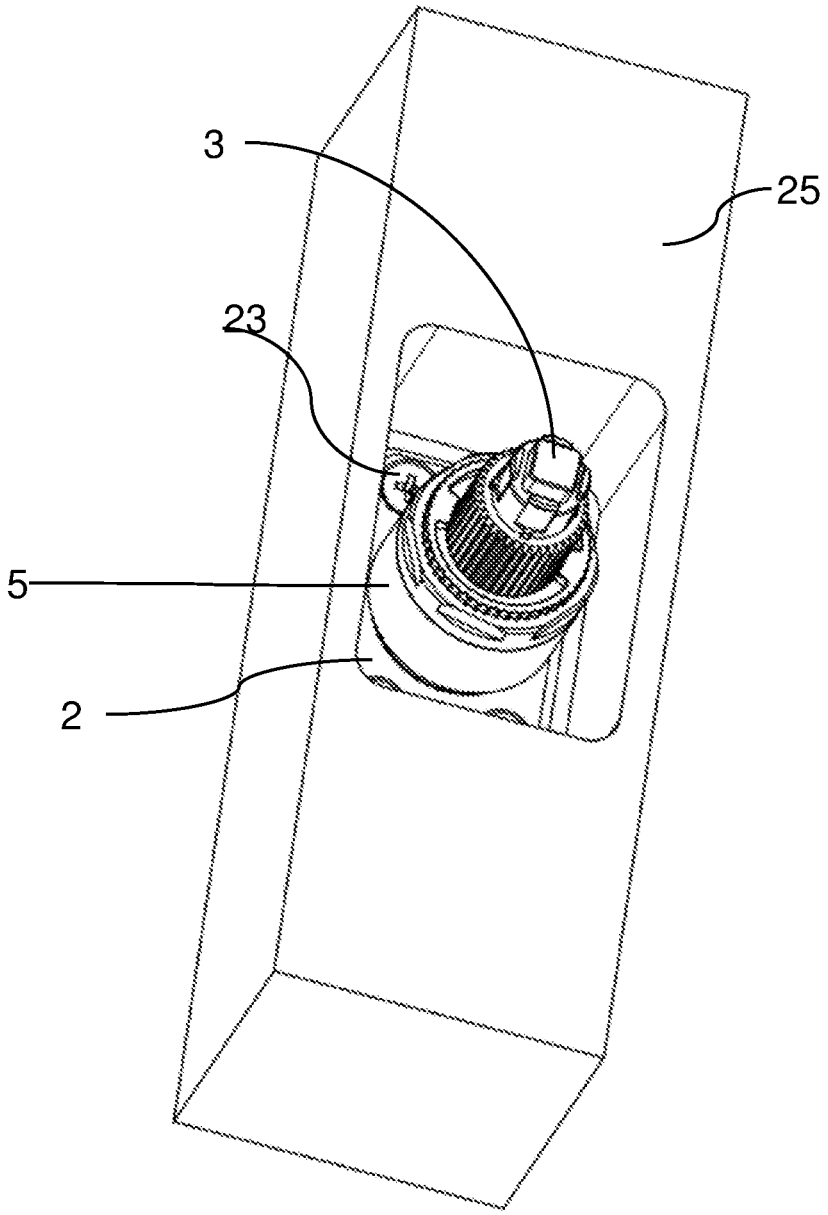
FIG. 25 shows the assembly module from FIG. 24 in a plugged-together state.

FIG. 25 shows the assembly module from FIG. 24 in a plugged-together state.

Figure 26:
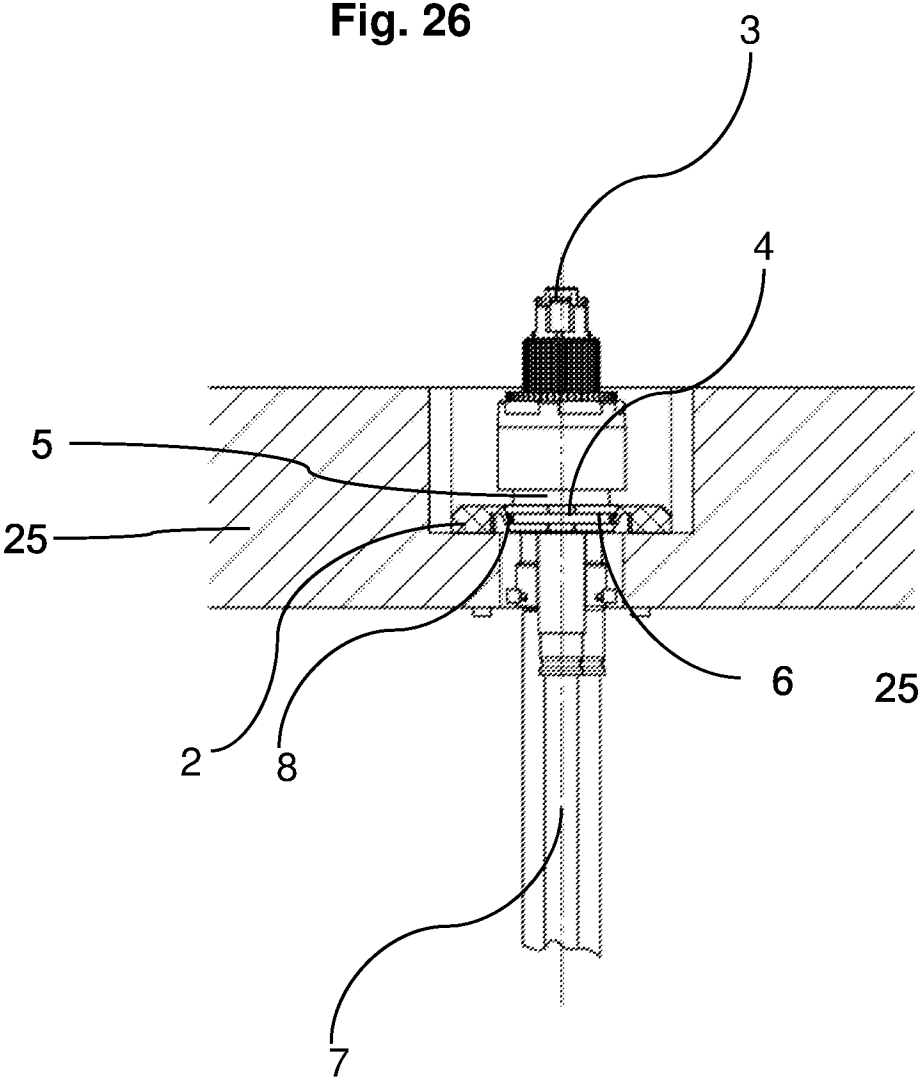
FIG. 26 shows a section through the assembly module from FIG. 25.

FIG. 26 shows a section through the assembly module from FIG. 25, wherein the section has been performed through the flexible tongue 8 and the receptacle body 25. Two encircling collars 4 are configured on the housing 5, whereby the collars 4 are beveled. The flexible tongue 8 protrudes inward in the direction of the housing 5. The flexible tongue 8 proximal to the head contacts the one encircling collar 4, while said flexible tongue 8 proximal to the foot bears on the other encircling collar 4. The flexible tongue 8 in the gripping portion 6 is manufactured so as to be oversized in relation to the housing 5, so that a certain force has to be overcome in order to connect the holding element 2 and the housing 5. This creates a deformation on the holding element 2 when this force is overcome. The flexible tongues 8 ensure an extraction safeguard which is fashioned to be free of play.

Figure 27:
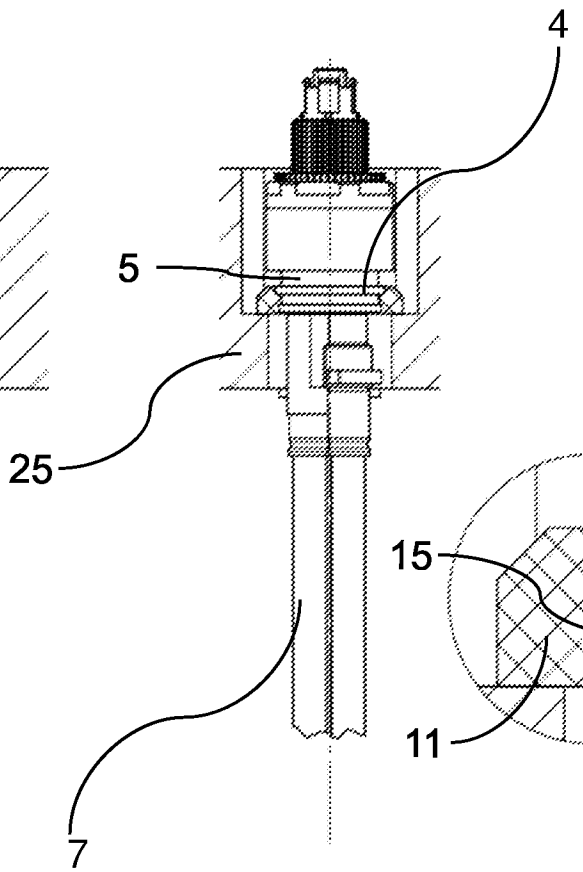
FIG. 27 shows another section through the assembly module from FIG. 25.

FIG. 27 shows another section through the assembly module from FIG. 25, wherein the section has been performed through the protrusions 11 on the holding element 2. The housing is not illustrated in a section in FIG. 27.

Figure 28:
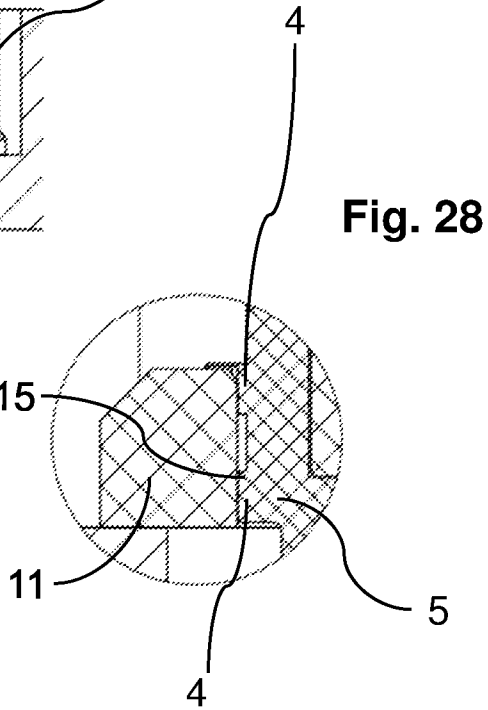
FIG. 28 shows an enlarged illustration of a sub-region of FIG. 27.

FIG. 28 shows an enlarged illustration of the sub-region of FIG. 27, wherein the housing 5 and the protrusion 11 can be seen. The two encircling collars 4 can likewise be seen, whereby the collars 4 are very flat in this region because the housing 5 here has a housing recess 15. It is also possible for the collars 4 to be completely absent in the housing recess 15. The collars 4 are not beveled in the region of the housing recess 15.

Figure 29:
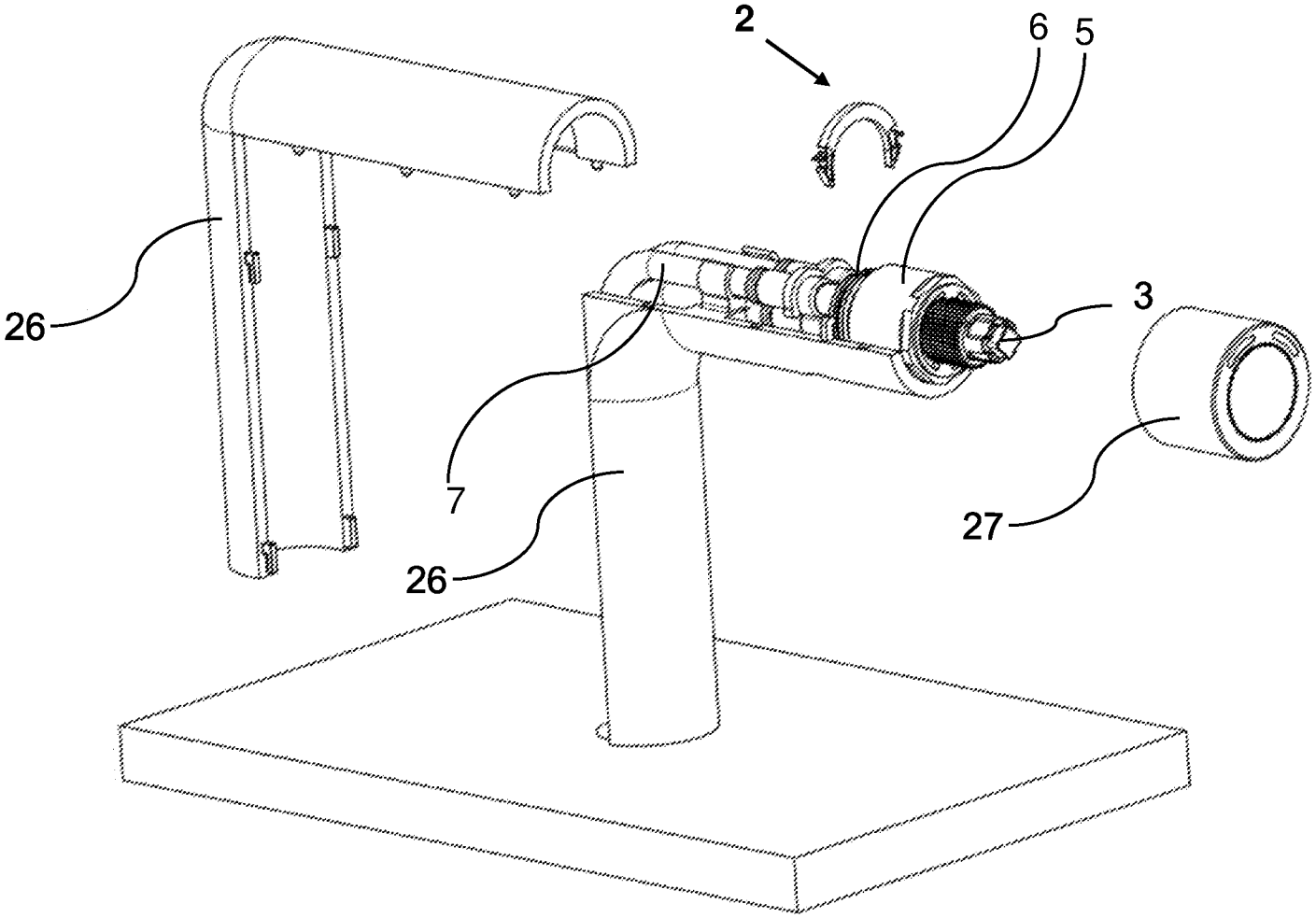
FIG. 29 shows another assembly module in an exploded illustration, having a detached holding element.

FIG. 29 shows another assembly module in an exploded illustration, having a detached holding element 2. The holding element 2 here is fashioned as a holding yoke. The sanitary functional unit 1 lies on a fitting part 26. A knob 27 is able to be connected to the activating element 3, whereby a user can operate the activating element 3 by manipulating the knob 27. The fitting parts 26 have burlings and notches so that the fitting parts 26 are able to be connected to one another and plugged into one another. The gripping portion 6 is configured on the housing 5 and is provided by the encircling collar 4. The function of the holding element 2 lies in achieving an extraction safeguard in the axial direction of the sanitary functional unit 1.

Figure 30:
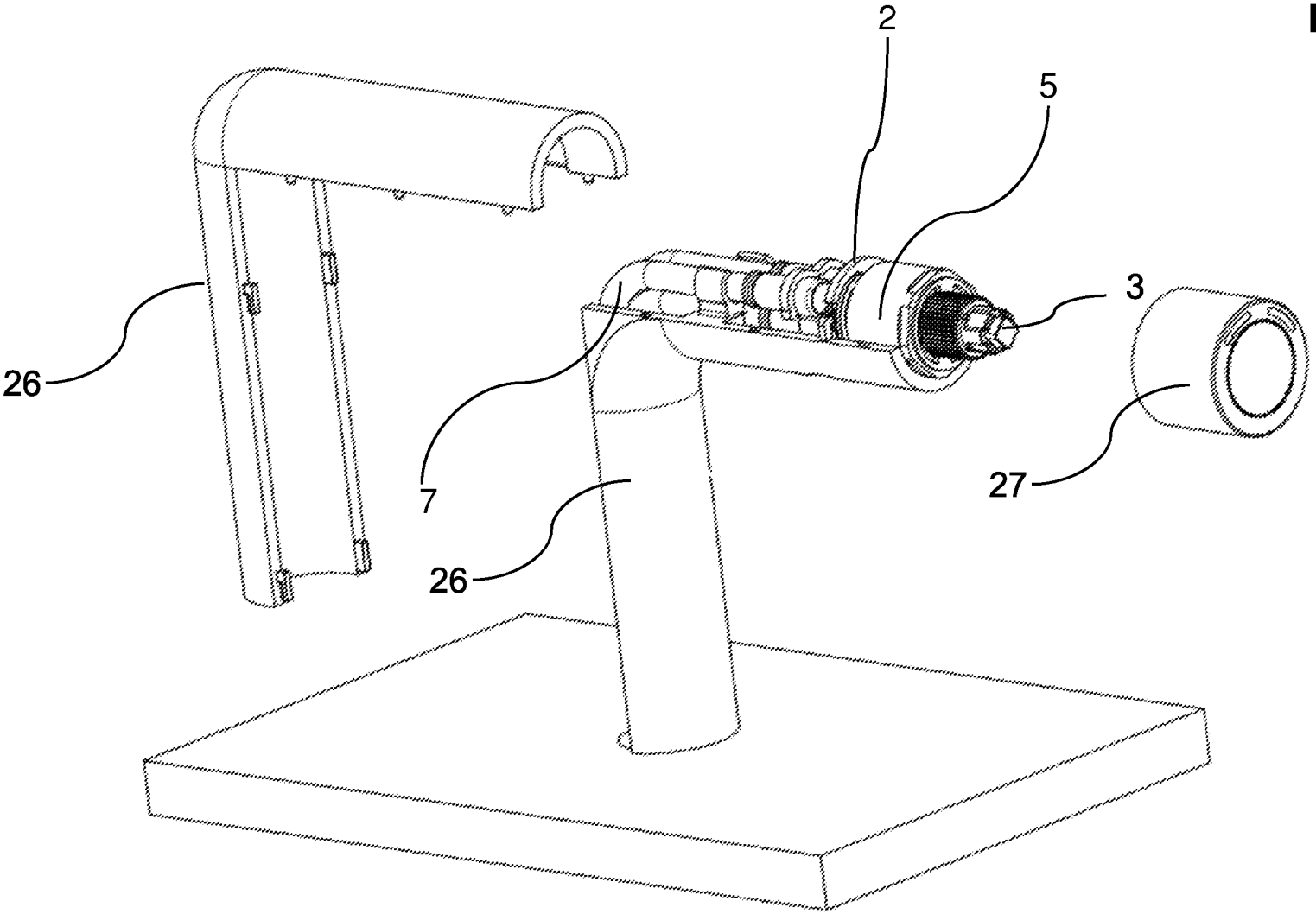
FIG. 30 shows the assembly module from FIG. 29 having a plugged-in holding element.

FIG. 30 shows the assembly module from FIG. 29 having a plugged-in holding element 2. The holding element 2 is configured as a holding yoke. The holding element 2 has two yoke springs 28 which can engage on fitting arms 29 on the fitting part 26. The plugged-in holding element 2 can be unplugged again by mutually compressing the yoke springs 28.

Figure 31:
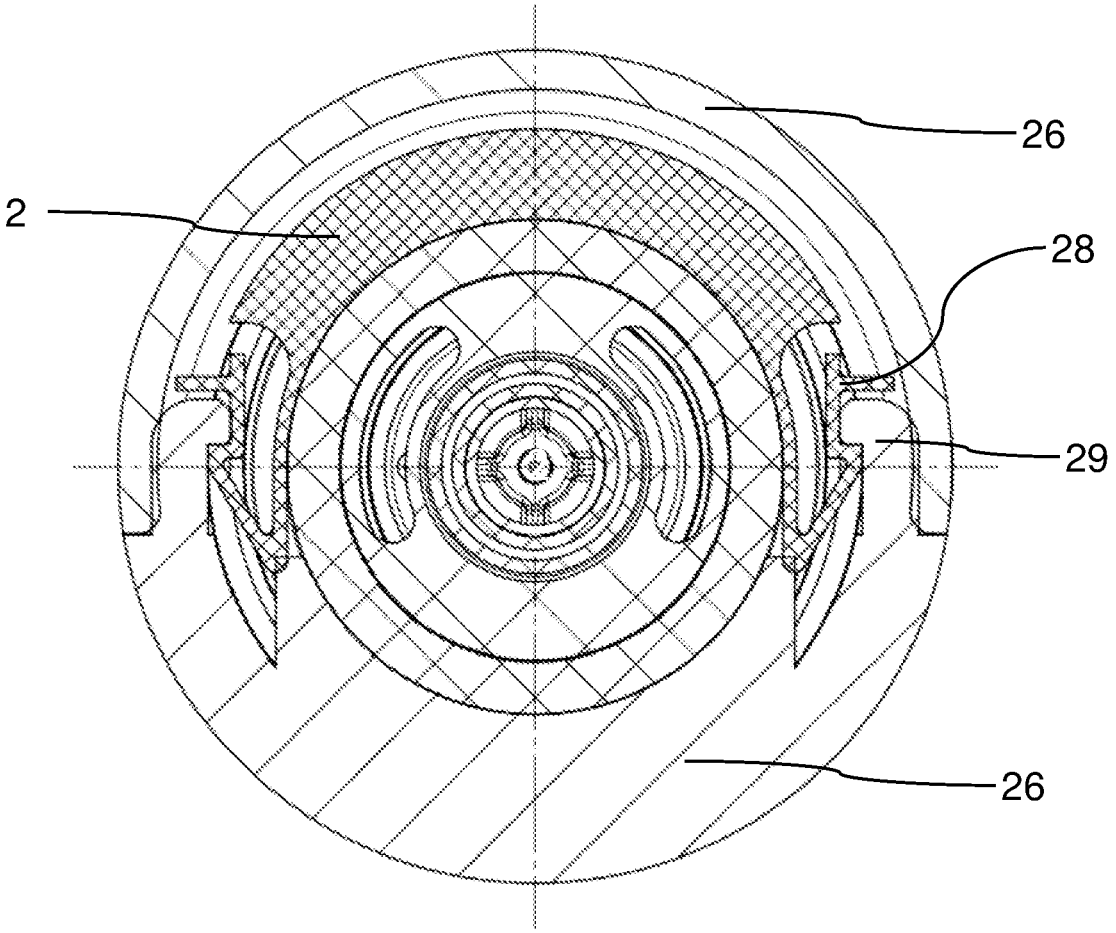
FIG. 31 shows a section through the holding element of a plugged-together assembly module from FIG. 30.

FIG. 31 shows a section through the holding element 2 of a plugged-together assembly module from FIG. 30. The holding element 2 possesses two yoke springs 28. The fitting part 26 possesses two fitting arms 29, whereby the yoke springs 28 are configured in such a manner that the latter can engage on the fitting arms 29. The fitting parts 26 lie on top of one another and are connected to one another by the burlings and notches (not visible here). The yoke springs 28 can latch into the fitting arms 29 of the fitting part 26, so that the sanitary functional unit can be prevented from falling out.

Figure 32:
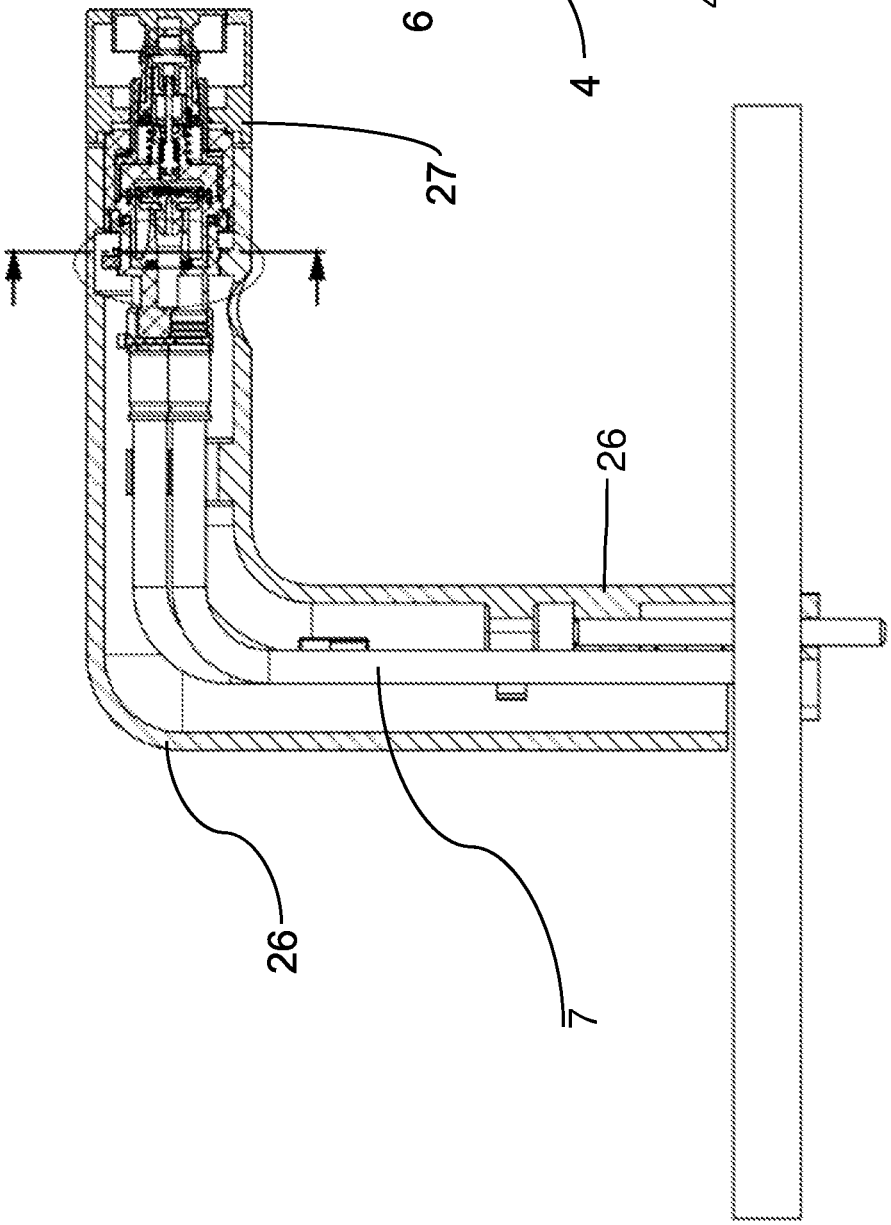
FIG. 32 shows a section through the plugged-together assembly module from FIG. 30.

FIG. 32 shows a section through the plugged-together assembly module from FIG. 30.

Figure 33:
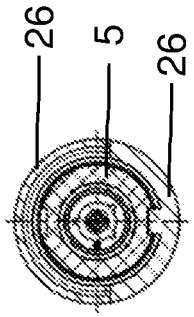
FIG. 33 shows a section through the plugged-together assembly module from FIG. 30.

FIG. 33 shows a section through the plugged-together assembly module from FIG. 30, wherein the sectional direction is indicated by the arrows in FIG. 32. A tongue-and-groove assembly is configured between the fitting part 26 and the housing 5.

Figure 34:
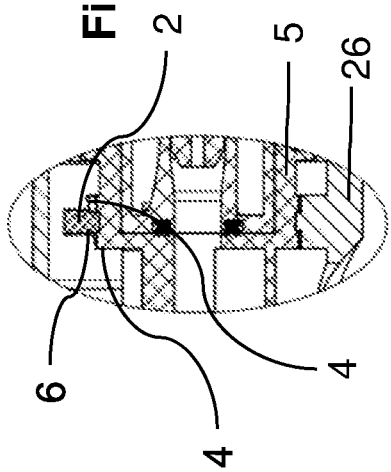
FIG. 34 shows an enlargement of a sub-region from FIG. 32.

FIG. 34 shows an enlargement of a sub-region from FIG. 32 (round region). The holding element 2, configured as a holding yoke, engages on the housing 5 in a gripping portion 6 which is provided by the encircling collars 4. The encircling collars 4 are beveled. The holding yoke has a thickness which increases from the inside to the outside. The cross section of the holding yoke is trapezoidal. Other cross-sectional shapes, for example triangular, are likewise conceivable. The holding element 2 is configured so as to be oversized in relation to the housing 5 and in particular in relation to the encircling collar 4. The width of the collar trench 14 here is between the minimum and the maximum thickness of the holding yoke, so that an adaptation which eliminates the play takes place. Therefore, the holding yoke does not bear directly on the collar trench 14, which is delimited by the two encircling collars 4, but floats above said collar trench 14 so to speak. A play-free safeguard in relation to extraction and falling out is achieved by the oversize.

In a sanitary functional unit having a housing and a holding element which at least in portions encompasses the housing it is proposed that the holding element contacts the housing in a gripping portion and in this gripping portion is manufactured so as to be oversized in relation to the housing.

LIST OF REFERENCE SIGNS

1 Sanitary functional unit
2 Holding element
3 Activating element
4 Encircling collar
5 Housing
6 Gripping portion
7 Pipeline, pipelines
8 Flexible tongue
9 External spring
10 Axial groove
11 Protrusion
12 Spring web
13 Housing part
14 Collar trench
15 Housing recess
16 Web bore
17 Oblique internal face
18 External body
19 External body groove
20 External body shoulder
21 Resting shoulder
22 Plug-in direction
23 Screw
24 Fastening bore
25 Receptacle body
26 Fitting part
27 Knob
28 Yoke spring
29 Fitting arm
30 External body protrusion

The invention claimed is:

1. A sanitary functional unit (1), comprising:

a housing (5);

a holding element (2), for holding the sanitary functional unit (2), which at least in portions encompasses the housing (5);

a gripping portion (6) on the housing, the holding element (2) contacts the housing (5) in the gripping portion (6) and the gripping portion (6) is oversized in relation to the housing; and at least one encircling collar (4) which provides the gripping portion (6) is configured on the housing (5), wherein the holding element (2) has at least one flexible tongue (8) which is foldable inwardly and engages with at least part of the gripping portion (6) for play-free mounting between the holding element (2) and the housing (5).

2. The sanitary functional unit (1) as claimed in claim 1, wherein the gripping portion (6) extends across at least 180° and/or at least half the circumference of the housing (5).

3. The sanitary functional unit (1) as claimed in claim 1, further comprising an anti-rotation safeguard is configured in the gripping portion (6) and the holding element (2).

4. The sanitary functional unit (1) as claimed in claim 1, wherein the holding element (2) is annular.

5. The sanitary functional unit (1) as claimed in claim 1, wherein the holding element (2) has a shape of a yoke.

6. The sanitary functional unit (1) as claimed in claim 1, wherein the holding element (2) has at least one fastening means for fastening to a support structure.

7. The sanitary functional unit (1) as claimed in claim 1, further comprising at least one externally accessible activating element (3).

8. The sanitary functional unit (1) as claimed in claim 1, further comprising at least one valve.

9. The sanitary functional unit (1) as claimed in claim 1, wherein the housing (5) has at least one connector for a water conduit, and the gripping portion (6) is disposed between the at least one connector and an activating element (3).

10. The sanitary functional unit (1) as claimed in claim 1, wherein the holding element (2) on an inside thereof has at least one protrusion (11) which is insertable into a housing recess (15) to form an anti-rotation safeguard.

11. The sanitary functional unit (1) as claimed in claim 1, wherein the holding element (2) includes an oblique internal face (17).

12. The sanitary functional unit (1) as claimed in claim 1, wherein the at least one encircling collar (4) is beveled.

13. The sanitary functional unit (1) as claimed in claim 1, wherein the holding element (2) has at least one spring web (12) which is coupled to the flexible tongue (8).

14. The sanitary functional unit (1) as claimed in claim 1, wherein the holding element (2) is yoke-shaped and has a thickness which increases from inside to outside, for a play-free mounting between the holding element (2) and the housing (5).

15. The sanitary functional unit (1) as claimed in claim 1, wherein the holding element (2) on an external side has at least one axial groove (10) which is connectable to an external body (18) to form an anti-rotation safeguard between the external body (18) and the holding element (2).

16. The sanitary functional unit (1) as claimed in claim 1, wherein the holding element (2) is formed of a plastics material.

17. A construction kit for the sanitary functional unit (1) as claimed in claim 1, comprising the at least one housing (5) and at least two different ones of the holding elements (2) which match the housing (5).

18. A sanitary functional unit (1), comprising:

a housing (5);

a holding element (2), for holding the sanitary functional unit (2), which at least in portions encompasses the housing (5);

a gripping portion (6) on the housing, the holding element (2) contacts the housing (5) in the gripping portion (6) and the gripping portion (6) is oversized in relation to the housing; and at least one encircling collar (4) which provides the gripping portion (6) is configured on the housing (5), wherein the holding element (2) on an external side has at least one axial groove (10) which is connectable to an external body (18) to form an anti-rotation safeguard between the external body (18) and the holding element (2), further comprising an external spring (9) disposed on the external side of the holding element (2), the external spring (9) at an end side is introducible into the external body (18) to form a play-free extraction safeguard.

19. A design series of sanitary functional units (1) having at least two variants, wherein each said variant is configured as a sanitary functional unit (1) comprising:

a housing (5);

a holding element (2), for holding the sanitary functional unit (2), which at least in portions encompasses the housing (5);

a gripping portion (6) on the housing, the holding element (2) contacts the housing (5) in the gripping portion (6) and the gripping portion (6) is oversized in relation to the housing; and at least one encircling collar (4) which provides the gripping portion (6) is configured on the housing (5), wherein the variants have identical housings (5) and mutually deviating ones of the holding elements (2).

20. The design series as claimed in claim 19, wherein in a first one of the variants the holding element (2) encompasses the housing (5) in an annular manner, and in a second one of the variants the holding element (2) encompasses the housing (5) only partially.

21. The design series as claimed in claim 20, wherein in the first variant the holding element (2) has at least one fastening means which defines a first plug-in direction, and in the second variant the holding element (2) has at least one fastening means which defines a second plug-in direction which is counter to the first plug-in direction.

* * * * *